United States Patent [19]

Austin et al.

[11] 4,327,266

[45] Apr. 27, 1982

[54] MICROWAVE OVENS FOR UNIFORM HEATING

[75] Inventors: Buddy J. Austin, Atkins; James E. Simpson, Coralville, both of Iowa

[73] Assignee: Amana Refrigeration, Inc., Amana, Iowa

[21] Appl. No.: 186,490

[22] Filed: Sep. 12, 1980

[51] Int. Cl.[3] ..... H05B 6/74

[52] U.S. Cl. ..... 219/10.55 F; 219/10.55 A

[58] Field of Search ..... 219/10.55 F, 10.55 A, 219/10.55 R

[56] References Cited

U.S. PATENT DOCUMENTS

| | | | |
|---|---|---|---|
| 2,748,239 | 5/1956 | Long et al. | 219/10.55 |
| 3,643,055 | 2/1972 | Suzuki et al. | 219/10.55 |
| 3,746,823 | 7/1973 | Whiteley | 219/10.55 |
| 3,872,276 | 3/1975 | Corcoran et al. | 219/10.55 F |
| 4,019,010 | 4/1977 | Tanaka et al. | 219/10.55 F |
| 4,092,513 | 5/1978 | Rasmussen | 219/10.55 F |
| 4,144,436 | 3/1979 | Hauck | 219/10.55 F |
| 4,176,266 | 11/1979 | Kaneko et al. | 219/10.55 F |

FOREIGN PATENT DOCUMENTS

| | | |
|---|---|---|
| 2310058 | 11/1976 | France . |
| 52-11446 | 12/1977 | Japan . |
| 52-41939 | 12/1977 | Japan . |
| 52-59343 | 12/1977 | Japan . |
| 1543980 | 4/1979 | United Kingdom . |

OTHER PUBLICATIONS

U.S. Patent Application Ser. No. 954,718, "Radiating Mode Stirrer Heating System", of William Teich, filed Oct. 24, 1978.

The SPEED Microwave Oven in Integrated Cooking", by A. L. Dungan et al., *Journal of Microwave Power*, 4(2), 1969, pp. 44–47.

*Primary Examiner*—B. A. Reynolds

*Assistant Examiner*—Philip H. Leung

*Attorney, Agent, or Firm*—Robert W. Hoke, II; James F. Hollander

[57] ABSTRACT

Microwave ovens typically have an oven cavity and a feed system for supplying microwaves through a feed opening into the cavity. Such ovens are inproved by providing a field stirrer rotatably mounted over and covering the feed opening. The field stirrer is a single conductive plate having a single radiating slot in the plate exposing only a portion of the feed opening to the cavity through the slot at any position of the plate during its rotation. The slot is in the shape of an arc or other shape which is tangentially longer than it is radially wide. The plate also has a plurality of wings, fins, or vanes outside the feed opening. The vanes and slot are arranged so that electrically identical positions of the plate occur only every full circle of rotation by virtue of bilateral symmetry at most. The plate is spaced from the feed opening and into the cavity by a sufficient distance to permit flow of microwave energy beneath the plate for distribution around the periphery of the plate and by the vanes. The geometry and dimensions of the slot, plate periphery, and vanes can readily be adjusted for best cooking in actual practice. In an additional embodiment the plate periphery cooperates with the feed opening in the manner of a slot without need of slotting the plate itself.

16 Claims, 17 Drawing Figures

FIG. 6
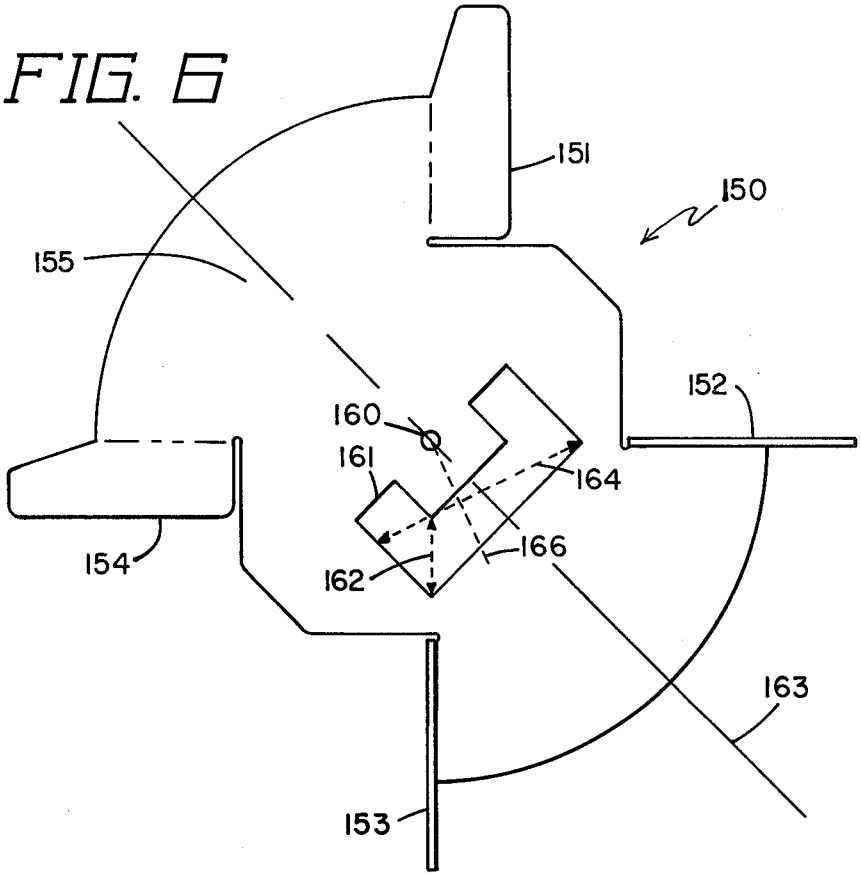
FIG. 7A
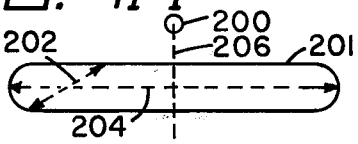
FIG. 7B
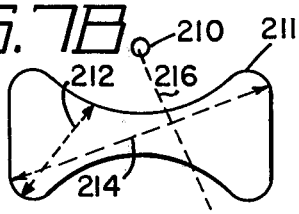
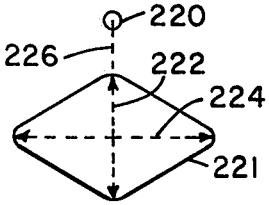
FIG. 7C
FIG. 7D
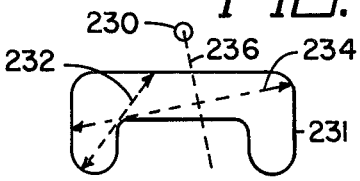
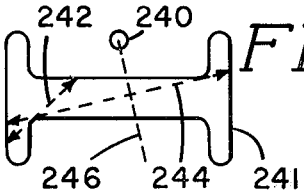
FIG. 7E
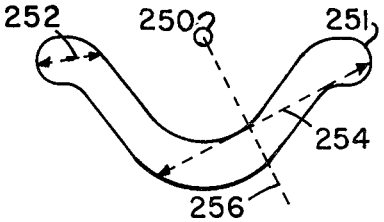
FIG. 7F

MICROWAVE OVENS FOR UNIFORM HEATING

BACKGROUND OF THE INVENTION

The present invention relates to the field of microwave ovens. More specifically, the present invention relates to improvements in microwave ovens having rotatable elements which "stir" the microwave energy for more nearly uniform cooking of each food body placed in the ovens.

It has long been recognized that microwave ovens offer advantageously rapid cooking of food bodies placed therein as compared with other types of ovens which heat food bodies from the outer surface of the food and rely on thermal conduction to heat the center. Because the microwave oven radiates microwave energy from a feed system into the oven cavity and the microwaves are absorbed by the food throughout its volume, the food is more rapidly brought to a temperature everywhere in its volume which suffices to cook the food. At the same time, however, the rapidity of cooking offered by microwave technique carries with it the unsatisfactory potential for undercooking some portions of the food when the rest is cooked until properly done, and for fully cooking such portions only if the rest is overdone. Such cold and hot spots can reduce the attractiveness of microwave oven technology if they cannot be eliminated by improvements in the technology.

The need for improvements has been recognized for many years in the prior art, which has provided various microwave "stirrers" for stirring up the heating pattern of the microwave energy and hopefully increasing the uniformity of cooking of food and other objects to be heated. This "stirring" is actually a combination of time-varying scattering, cavity perturbation, and alteration of cavity excitation.

Microwave ovens are usually metallic cavities provided with reclosable doors, and a magnetron or other generator of microwave power is coupled by means of a waveguide arrangement to the cavity. Some ovens are provided with turntables to turn the food in the cavity to increase uniformity of cooking. Other microwave ovens are provided with stirrers which look like propeller blades turning on a wall of the oven cavity at a distance from the opening of the waveguide into the cavity. Some other stirrers are provided so as to turn inside the waveguide itself, and not in the cavity. Still other stirrers are provided in the cavity over the opening of the waveguide into the cavity.

Truly effective stirring, or truly uniform cooking of all types and sizes of food objects, in a microwave oven is an objective perhaps more often hoped for than fully met in much of the prior art, and even if met, the stirring arrangement may entail substantial manufacturing cost. The complex geometry of microwave ovens and stirrers has defied effective mathematical analysis and prediction if only because the shape and position of food being cooked is changed from use to use. Accordingly, persons skilled in the art have been forced to use trial and error experimental techniques because the ability to predict superior performance in ovens with stirrers is so limited.

Thus, it is of considerable interest to the microwave oven art to learn new ways of obtaining more truly uniform cooking and heating without increasing cost of manufacture. It is of corresponding interest to the art to find new ways of obtaining at least comparable uniformity of cooking in microwave ovens while decreasing the cost of manufacture, so that the potential utility of microwave ovens to the general population and to specialized users can be more fully realized.

SUMMARY OF THE INVENTION

A microwave oven construction has been discovered which after considerable experimentation and refinement has been found to be advantageously uniform in cooking many types of food objects while maintaining low cost in the stirrer construction.

The micowave oven has a main oven body having walls and suitably a reclosable door defining a heating cavity and also has a high frequency feeder section having a feeder opening for supplying microwave energy into the heating cavity. A stirrer is provided which is a planar, or flat, rotatable antenna plate having one and only one inner edge defining a single aperture for admission of the microwaves from only a part of the feeder opening directly across the plane of the plate to the oven cavity. The antenna plate is made of electrically conductive material having several wings on its periphery. The plate is located in the oven cavity and has a spacing from the feeder opening so as to permit propagation of microwaves not only from part of the feeder opening through the aperture but also beneath the plate from the rest of the feeder opening to the wings and thence to the cavity. A balance results between aperture radiation and wing radiation which when achieved as in the preferred embodiment results in highly uniform microwave heating of all types of food and other objects being processed by the invention.

The stirrer of the inventive microwave ovens is rotated on an axis of rotation and suitably by means of a rotatable shaft entering a coaxial inside surface of the waveguide opening or aperture of the feeder section. The shaft is attached at a point on the antenna plate where the axis of rotation intersects the stirrer plate, for example.

The stirrer exhibits a number of interesting geometric features which are believed to be related to its advantageous properties.

The microwave antenna plate aperture is oriented so that instead of lying mostly in a radially outward direction, it is an opening lying mostly in a tangential or circumferentially disposed position without totally encircling the axis of rotation. In other words, the slot is tangentially longer than it is radially wide. Beyond this, the shape of the aperture is not very critical and may be adjusted to suit the needs of the skilled worker. The geometry of the plate aperture also appears to be definable as being one such that the longest straight line which can be drawn inside the aperture in the plane of the plate along a radius through the axis of rotation is shorter than the longest straight line which can be drawn inside the aperture perpendicular to any radius through the axis.

If the requirements of a design require any nonradiative ventilation holes or bolt holes in the stirrer plate which are so small as not to admit significant microwave energy, these may also be provided, but they are not considered a microwave aperture for the present purposes. The invention also comprehends embodiments not having a plate inner edge, or slot, but rather a small-radius outer peripheral edge cooperating with the waveguide opening to admit some direct radiation in much the same manner as a slot.

Another geometric feature of the stirrers in the inventive ovens is a relatively low degree of symmetry. To permit the most effective stirring, the geometry of the stirrer plate is arranged so that electrically identical, or geometrically congruent, positions of the plate occur only every full circle of rotation. The plate can be asymetrical or can exhibit bilateral symmetry at most. In the case of bilateral symmetry the plate is made so as to have a bisector being a one and the only one axis of bilateral symmetry.

The wings, also called vanes or fins, of the stirrer can be adjusted in their angle, size, and shape. As a result, the geometry of the stirrer plate provides many degrees of freedom in adjusting the radiation pattern of different ovens to eliminate hot and cold spots. At the same time, there is an advantageous feature of relative separation in the spatial location of those parts of the radiation pattern controlled by the plate aperture, or slot, as compared with the vanes, reducing the amount of trial and error required in making adjustments.

The stirrer is advantageously made of inexpensive sheet metal and slotted and bent to shape by inexpensive manufacturing steps, achieving a goal of economy together with very satisfactory heating characteristics.

BRIEF DESCRIPTION OF THE DRAWING

FIG. 6 is a plan view of an alternative stirrer plate for use in microwave ovens according to the invention.

FIGS. 7A through 7F are geometric analyses of some alternative openings in stirrer plates like the plate of FIG. 6.

DETAILED DESCRIPTION OF THE DRAWING

Figure 1:
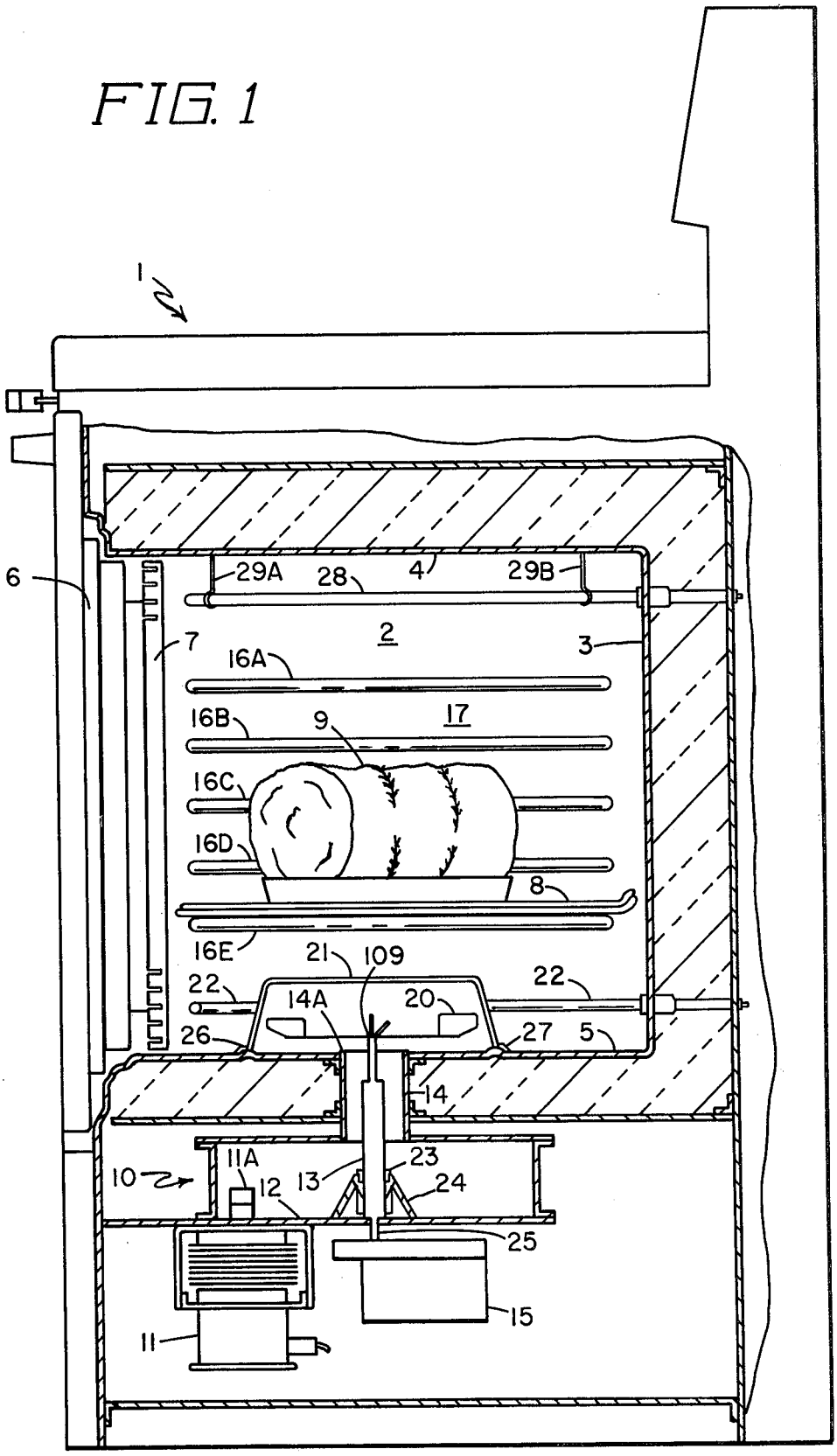
FIG. 1 is a side view of a microwave oven according to the invention shown partially in cross-section.

FIG. 1 shows the preferred embodiment microwave oven 1 of the invention in partial cross-section. The FIG. 1 depicts an oven 1 of the common-cavity type with conventional heating elements 22 and 28 although the usefulness of the invention is not limited to ovens of this common-cavity type. Oven 1 includes an insulated case or oven body including a closed metallic cavity 2 defined by rectangular parallelepiped walls such as back wall 3, top wall 4, bottom wall 5, left side wall 17, a right side wall (not shown), and reclosable door 6. Door 6 has a microwave choke 7 of known type for preventing escape of microwaves during heating and cooking. A grill 8 is supported on one of several supporting ridges 16A,B,C,D, or E in left and right side walls 17 and 18. Food body 9 is inserted through door 6 onto grill 8 for cooking, and the food body acts as an energy-absorbing load in the oven 1 from a microwave point of view.

A microwave feed system, or feeder section, 10 is provided near bottom wall 5 to provide the microwave energy to be absorbed in the cavity 2. Feed 10 includes a magnetron generator of microwave energy 11 operating at 2450 MHz. and having coupling 11A to waveguide box 12. The microwave energy from magnetron 11 passes through waveguiding box 12 to a coaxial waveguiding portion of the feed having cylindrical metal tube 14 and inner coaxial shaft 13. Tube 14 terminates and ends at feeder opening, or feed aperture 14A, which is approximately centered on bottom wall 5 of oven cavity 2. Shaft 13 projects and extends beyond feed aperture 14A and holds stirrer antenna plate 20 at a point of attachment 109 so that shaft 13 provides a spacing of plate 20 from feeder opening 14A. Shaft 13 is rotatably mounted in plastic bearing 23 in cylindro-conical microwave seal 24 and driven at stud 25 by a.c. motor 15 suitably at 30 r.p.m. Stirrer 20 is rotatably mounted over and covers feed aperture 14A. Stirrer 20 is protected from oven spatter by ceramic cover 21 fastened to wall 5 by clips 26 and 27.

An auxiliary resistive heating rod, or hoop, 22 is also provided near wall 5 of oven 1. In addition, a broil element 28 is hung from the top wall 4 by wire hooks 29A and 29B.

Figure 2A:
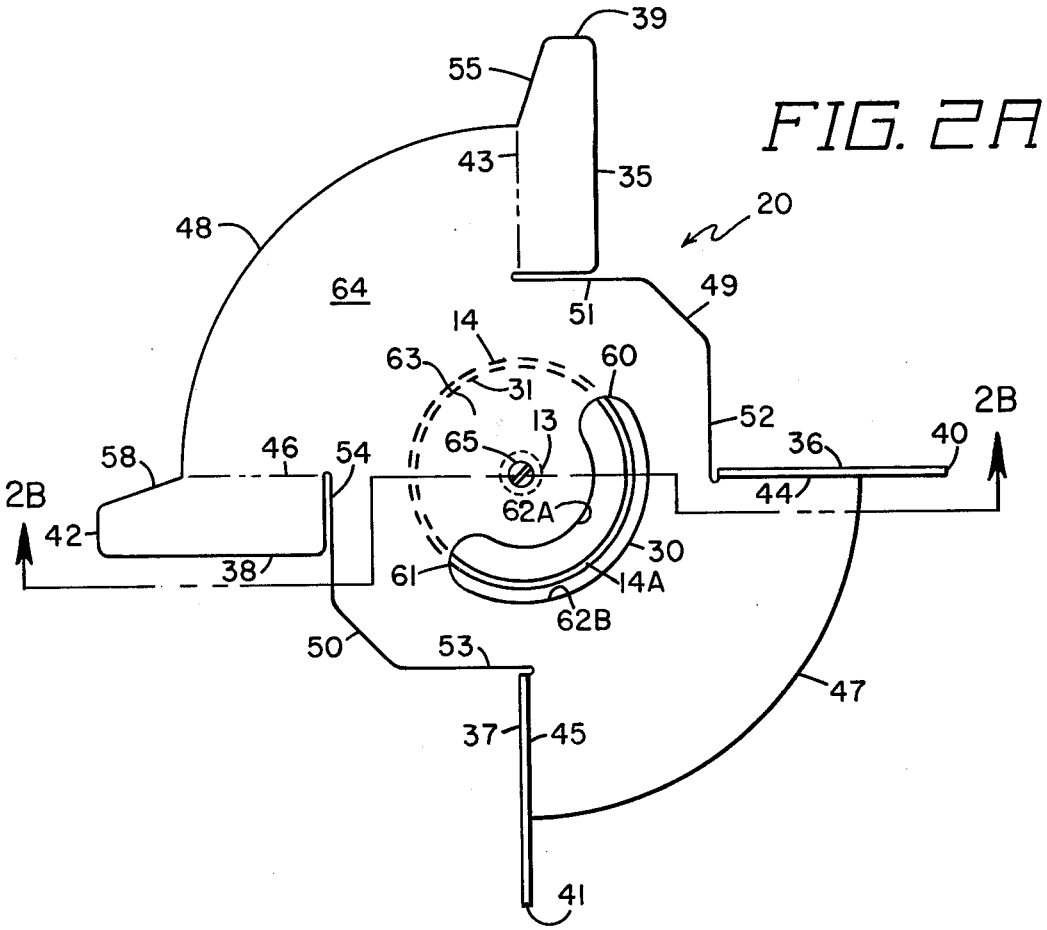
FIG. 2A is an enlarged plan view of a stirrer antenna and coaxial part of the feed used in the microwave oven of FIG. 1.
Figure 2B:
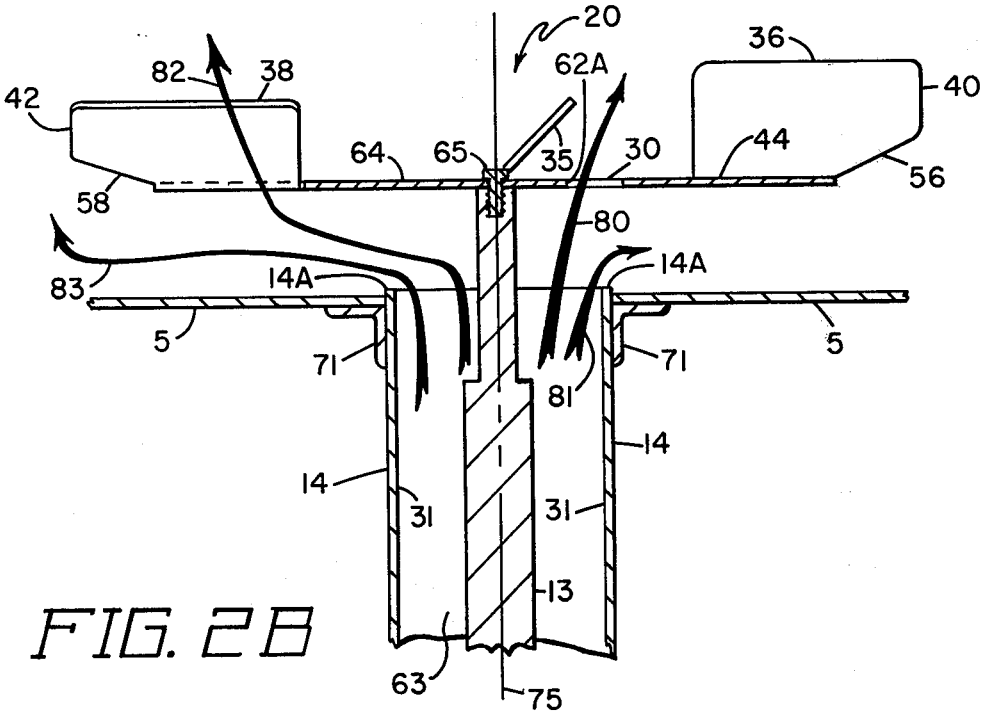
FIG. 2B is a side view of the stirrer antenna and coaxial part of the feed shown in section along the cutting line 2B in FIG. 2A.

FIGS. 2A and 2B show the stirrer antenna 20 of the preferred embodiment in enlarged views with the coaxial feed aperture 14A and coaxial feed 13,14 attached to wall 5 therebeneath. The coaxial line portion of the feed is described first.

Coaxial waveguide feed portion 14 has an inside surface 31 of approximately circular cross-section near oven wall 5. Inside surface 31 has an axis 75 which is also the axis of stepped cylindrical shaft 13 and the axis of rotation for stirrer antenna 20. The rotatable shaft 13 is affixed to antenna 20 by screw 65. Shaft 13 is disposed coacially within inside surface 31 of waveguiding tube 14 and defines a cross-section 63 which is substantially annular, or doughnut-shaped between shaft 13 and inside surface 31 at feed aperture 14A. Thus, feed 10 of FIG. 1 is arranged for passage of microwaves through coupling box 12 and then through the coaxial feed end 13,14, the microwaves entering cavity 2 for stirring by antenna 20 and uniform heating of food body 9.

Stirrer antenna 20 is a winged flat plate lying in plane 64. Plate 20 is attached to shaft 13 substantially perpendicular to axis of rotation 75. The planar antenna plate 20 has, or forms within itself, one and only one inner edge which defines a single arcuate aperture 30 in the shape of a curved slot or opening having a short edge portion, or inside radius portion 62A, a long edge portion, or outside radius portion 62B, and rounded slot-end edge portions 60 and 61. The arc-shaped slot, or arcuate aperture, 30 admits microwaves 80 from the feeder section 10 from only part of the annular cross-section 63 of the feeder opening 14A directly across the plane 64 of the plate 20 to the oven cavity 2. Radiatively, the slot 30 exposes only a portion of the feed aperture 14A to the cavity 2 through the slot 30 at any position of the plate 20 during rotation of the plate 20. Thus, the aperture 30 functions as a slot antenna excited by the circumferntial magnetic field of the coaxial feed end 13,14.

Antenna plate 20 is suitably made of electrically conductive, bendable material such as aluminum. Plate 20 has a periphery with segments 48,49,47, and 50 from which part of the plate material is bent from the periphery as four wings 35,36,37, and 38 thereon. Plate 20 is supported outside the aperture 14A and into the cavity 2, and the wings 35,36,37,38 are located radially outward of the inside surface 31 of feed aperture 14A. Each of the four wings, or fins or vanes, 35,36,37, and 38 has wing tip 39,40,41, and 42 respectively which project and extend radially beyond the radius of arcuate edge portions 47 and 48 of the periphery of plate 20. Each wing tip 39,40,41, and 42 is trimmed diagonally from tip down to an arcuate peripheral edge 47 or 48 to form oblique wing edges 55,56,57 (not shown), and 58 respectively. Wings 35,36,37, and 38 are advantageously bent from plane 64 along bending lines 43,44,45, and 46 for inexpensive manufacture, exposing peripheral edge cuts 51,52,53 and 54. The relationship in position of the wings and plane 64 portion of plate 20 is maintained fixed relative to wall 5 by means of collar 71 attached to wall 5 and tube 14. Microwaves 81,82 and 83 from the rest of the annular cross-section 63 of feeder opening 14A not delivering microwaves 80, propagate from feed aperture 14A between plate 20 and wall 5 which together serve as a parallel plate radial transmission line whose currents continue onto wings 35,36,37, and 38 and whose electric fields excite radiation into cavity 2 at the plate peripheral edges 48,49,51,52,47,53,50 and 54.

Figure 3A:
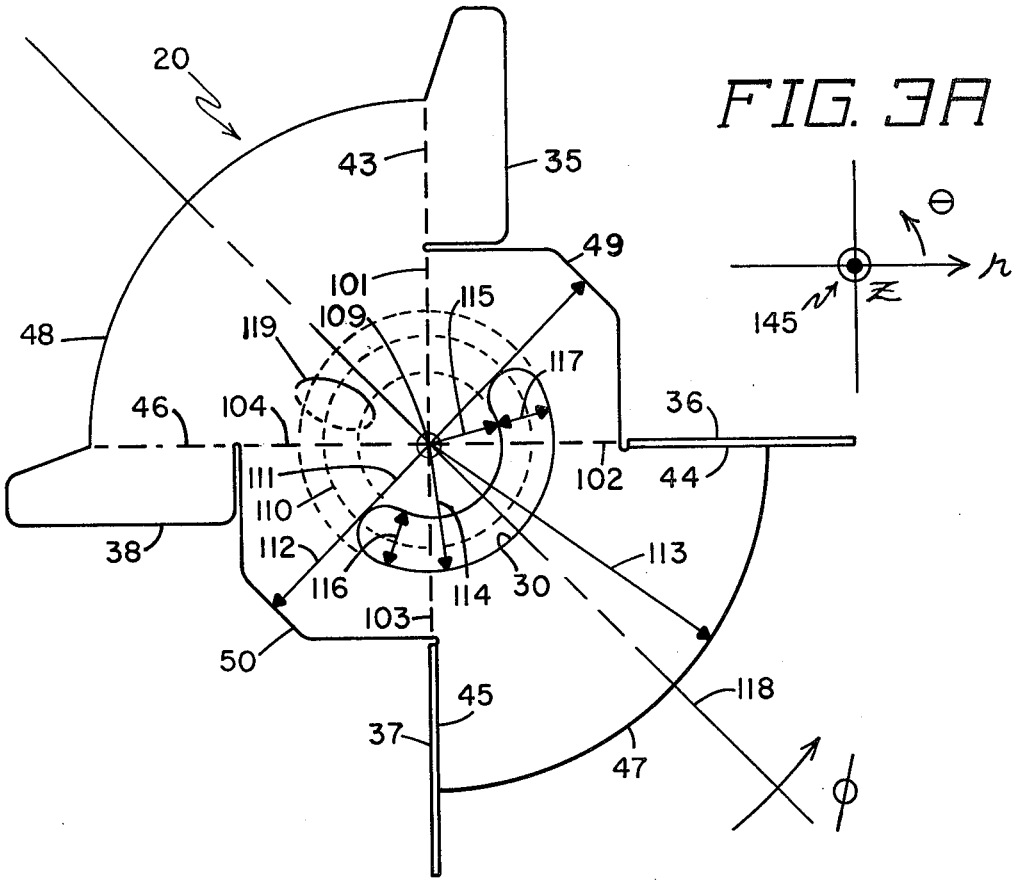
FIG. 3A is a plan view of the stirrer antenna only, for use in emphasizing the geometry and relative dimensions of the stirrer antenna.
Figure 3B:
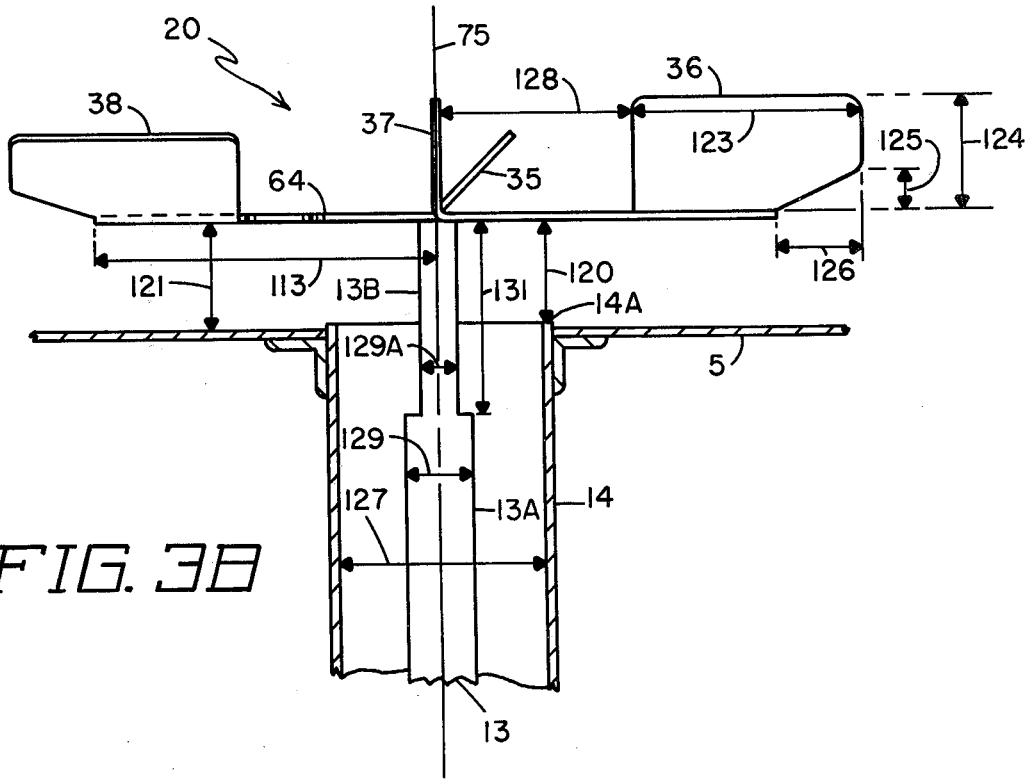
FIG. 3B is a side view of the stirrer antenna of FIG. 2A with sectioned feed, for use in emphasizing the geometry and relative dimensions of the antenna and feed.

Referring now to FIG. 3A, the geometry of the plate 20 in the preferred embodiment is further discussed. Arcuate aperture 30 subtends an angle suitably between 150° and 210° and is centered on the axis of rotation 74 (FIG. 3B). Tangent line 111 is drawn so as to touch the two ends of the arcuate aperture 30, and since line 111 passes through the center of imaginary circle 110 of which aperture 30 forms a part, it is apparent that the aperture subtends a full half circle or 180° in FIG. 3A. The imaginary circle 110 has its center at the point of attachment 109 where shaft 13 is attached to and holds plate 20. Point 109 is also the point of intersection of axis of rotation 75 and plane 64 of plate 20. The aperture being arcuate, it forms part of the imaginary circle 110 and part of a circular band or ring 119 including circle 110 and having the same center 109.

Wings 35,36,37, and 38 are bent from the periphery of the plate 20 along bending lines 43,44,45, and 46. It is observed that imaginary radius lines 101,102,103, and 104 are able to be drawn in plane 64 from point of attachment 109 on axis of rotation 75 and that the bending lines 43,44,45, and 46 lie along the radius lines 101,102,103, and 104 respectively. The bending lines 43,44,45, and 46 are successively spaced at right angles, or 90°, around plate 20. The slot 30 is cut so that it extends through an arc having a chord 111, the tangent line 111 previously referred to, which is at a 45° angle to every bending line 43,44,45, and 46.

As seen in FIGS. 3A and 3B, two of the adjacent wings 35 and 38 are bent at an acute angle relative to the plane 64 of the antenna plate 20, and this acute angle is suitably between 30° and 60° in the preferred embodiment, a 45° degree angle being found quite advantageous. The other two adjacent wings 36 and 37 are bent at substantially right angles, 90°, relative to the plane 64 in the preferred embodiment, and are bent at acute angles in other embodiments as needed.

In the present disclosure technical terms involving symmetry are used to suggest advantageous features in ovens and stirrers. An object has the highest degree of symmetry, radial symmetry, as a stirrer when the object is divided into two halves which are mirror-images of each other by every geometric plane through which the axis of rotation 75 passes. An object has the next-highest degree of symmetry, multiply-bilateral symmetry, when the object is divided into two halves which are mirror-images of each other by no more than a countable number of geometric planes through which the axis of rotation 75 passes.

A stirrer object has the highest degree of symmetry used in the present invention, simply called "bilateral symmetry" when the object is divided into two halves which are mirror-images of each other by one and only one geometric plane including the axis of rotation 75. The line of intersection of the dividing plane with the stirrer plate 20 is called a bisector, or axis of bilateral symmetry.

An object has the least degree of symmetry, assymetry, when there is no geometric plane including the axis of rotation which divides the object into two halves which are mirror-images of each other. The symmetry of a stirrer object for the present purposes not only depends upon the shape of the antenna 20 but also upon its point of attachment and the axis of rotation 75. For example, a circular plate having no slot and no wings is radially symmetrical for the present purposes when the axis of rotation is arranged to be through its center and the plate is provided with its plane perpendicular to the axis of rotation. However, for all off-center attachments of the same circular plate keeping the plate with its plane perpendicular to the axis of rotation 75, the circular plate is no more than bilaterally symmetrical, since there is only one plane which divides the plate into two halves which are mirror-images and still includes the axis of rotation.

Bilaterally symmetrical and assymetrical stirrer antennas are both quite useful since both require a full circle, or 360°, of rotation, to return to electrically, or physically, identical positions. In other words, a stirrer antenna is used herein which is at most bilaterally symmetrical. This is significant because such an antenna permits a large variety of field configurations to be set up in an oven cavity 2 during each full circle of rotation of the antenna. In the preferred embodiment oven the stirrer component as shown in FIG. 3A has a bisector, or axis of bilateral symmetry, 118, and there is no other such bisector.

The bilateral symmetry of stirrer antenna 20 results from the placement of the aperture 30 to one side of the attachment point 109. This interrupts currents flowing radially outward from the center and causes a dissimilar potential on the wings on opposite sides of the aperture 30. Thus, the wings 35,36,37,38 and the aperture 30 tend to radiate a field in a direction perpendicular to the plane 64 of the antenna plate 20 with an electric field vector parallel to the axis of bilateral symmetry 118.

Some stirrers, covering the opening of the waveguide, are excited with microwave currents which retain a stationary reference with respect to the cavity. Thus, the currents on a particular part of such a stirrer vary with its motion. The preferred embodiment, by contrast, provides a microwave entry port 63 whose fields are so oriented to the rotational axis 75 of the stirrer 20 that the stirrer is excited equally at all angles $\phi$ of its rotation and the currents and radiation pattern of the stirrer 20 are seen to be at least approximately constant to an imaginary observer riding on the stirrer 20. Such a stirrer functions as a rotating antenna, scanning a more or less constant radiation pattern through the interior of the oven. Cooking uniformity is improved by this technique since all portions of the food at the same distance from the source and at the same radius r from the axis of rotation 75 receive the same time-average fields. Further improvement in uniformity is obtained by controlling the radial distribution of the radiation pattern which is a function of the particular design of the stirrer constructed according to the principles herein. One form of entry port which provides a desirable stirrer excitation which is equal at all angles $\phi$ of rotation is a coaxial transmission line, operating in the TEM mode.

The preferred embodiment is next described in even more specific geometric and dimensional detail to more fully disclose its construction without, however, suggesting any limitation on full scope of the present invention which is defined in the claims.

Because the invention is contemplated for use in a variety of microwave ovens potentially using microwaves of different frequencies, the sizes of parts of the preferred embodiment are set forth in terms of the free-space wavelength of the microwave energy used. At the typical microwave oven frequency of 2450 MHz. the free-space wavelength is about 5 inches. In general, the free-space wavelength of microwaves of a given frequency f is computed by the formula 300/f(MHz) and the result of the calculation is in meters, where 1.0 meter is 39.37 inches. For brevity, the phrase "free-space wavelength" is abbreviated as "L" hereinafter.

In the preferred embodiment stirrer antenna 20 has the arc-shaped slot 30 having an inside radius 115 and an outside radius 114 centered on axis of rotation 75 at point 109. The outside radius 114 is quite suitably set between 1½ times and 2½ times inner radius 115 with the outside radius being suitably within plus or minus 40% of being 0.25 L, one quarter wavelength. In an experimental model the radius ratio was 1.8 and the outside radius 114 was 9/40 L. Slot 30 has rounded inside ends 60 and 61 with diameters 117 and 116 suitably equal to the difference of the inside and outside radii 115 and 114.

Each vane has a radial dimension 123 suitably being within plus 50% or minus 20% of being 0.40 L (0.40 L in model) and has a transverse dimension 124 suitably being within plus 20% or minus 50% of being half (0.50) of the radial dimension 123 (0.50 in model). The trim dimensions 125 and 126 in the model are approximately ⅜ of the transverse dimension and ⅜ of the radial dimension respectively. The vanes 35,36,37, and 38 are located in the model so that at least part of each vane is located 0.60 L away from axis of rotation 75, with dimension 128 being 0.35 L and the sum of dimensions 123 and 128 being 0.75 L so that the inner and outer vane edges bracket a 0.60 L distance from axis 75.

Each arcuate peripheral edge portion 47 and 48 is an outer edge portion of plate 20 having a radius of curvature 113 centered on axis 75 of length suitably being within plus or minus 20% of 0.60 L (0.60 in model). Peripheral opposite straight edge portions 49 and 50 are equidistant from center 109 and parallel with a distance between them suitably being within plus or minus 20% of being 0.80 L (0.80 in model).

The balance of direct (aperture) and indirect (vane) radiation is influenced in those embodiments using a slot 30 at least to some extent by the relative location of the slot 30 and the size of the antenna plate 20 as a whole. A way of describing the size of the plate 20 involves a "maximum radial extent dimension" which is here defined as the greatest distance from the center 109, where axis 75 intersects plate plane 64, to any part of the periphery of the plate 20 which lies in the plane 64. For example, the maximum radial extent dimension of plate 20 as drawn in FIG. 3A is radius 113 to arcuate peripheral edge 47. The relationship of slot to plate size is suitably such that outer radius 114 is within plus or minus 20% of being 0.40 of the maximum radial extent dimension or suitably such that inner radius 115 is within plus or minus 20% of being 0.20 of the maximum radial extent dimension.

It is to be emphasized that design ranges and dimensional tolerances set forth in this detailed description do not necessarily represent limits of useful values or limitations of the full scope of the invention, but rather are set forth for the general guidance of the skilled worker in preparing designs closely similar to preferred embodiment.

The arc-shaped slot 30 exposes only a portion of the feed aperture 14A to cavity 2 through the slot 30 at any position of plate 20 during rotation. The size of the portion of the feed aperture 14A exposed is adjusted by changing the inside and outside radii 115, 114 and the subtended angle of the slot. The antenna plate 20 is located close in over the feed aperture 14A in order that the geometric advantages of plate 20 can have a substantial effect in programming the radiation pattern. Accordingly, the spacing 120 of plate 20 from the feed end 14A and the spacing 121 of plate 20 from the surface of wall 5 are respectively fixed to as to permit indirect radiation 81,82,83 to escape beneath plate 20 between the plate 20 and wall 5. Dimensions 120 and 121 are set so that they are large enough to permit escape of indirect radiation 81,82,83 but small enough to encourage substantial direct radiation 80 from feed end 14A across plane 64 to cavity 2. The spacings 120 and 121 are suitably set between 0.025 L and 0.25 L. Satisfactory values tested include (A) spacings 120 and 121 both equal to 0.05 L and (B) spacing 120 equal to 0.05 L and spacing 121 equal to 0.11 L.

Referring to FIG. 3B, coaxial feed portion 13,14 has a ratio of the outside diameter 129 of lower center shaft 13A to inside diameter 127 of tube 14 equal to one-third(⅓). Inside diameter 127 of tube 14 is ⅜ L. Upper center shaft 13B is an impedance matching section. The ratio of diameter 129A of upper shaft 13B to diameter 129 of lower shaft 13A is 0.5488. Length 131 of upper shaft 13B is 0.391 L, when spacing 121 is 0.11 . Length of upper shaft 13B is 0.338 L, when spacing 121 is 0.05 L.

Figure 4A:
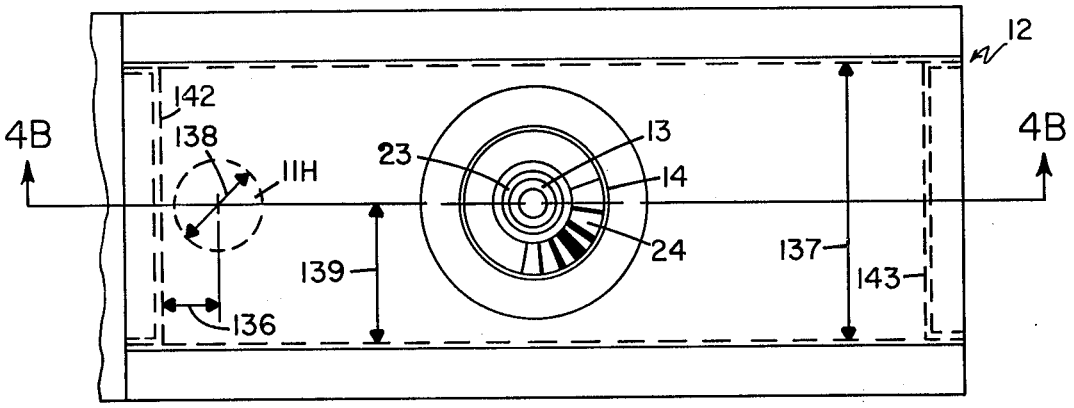
FIG. 4A is a plan view of the waveguide coupling box used in the oven of FIG. 1.
Figure 4B:
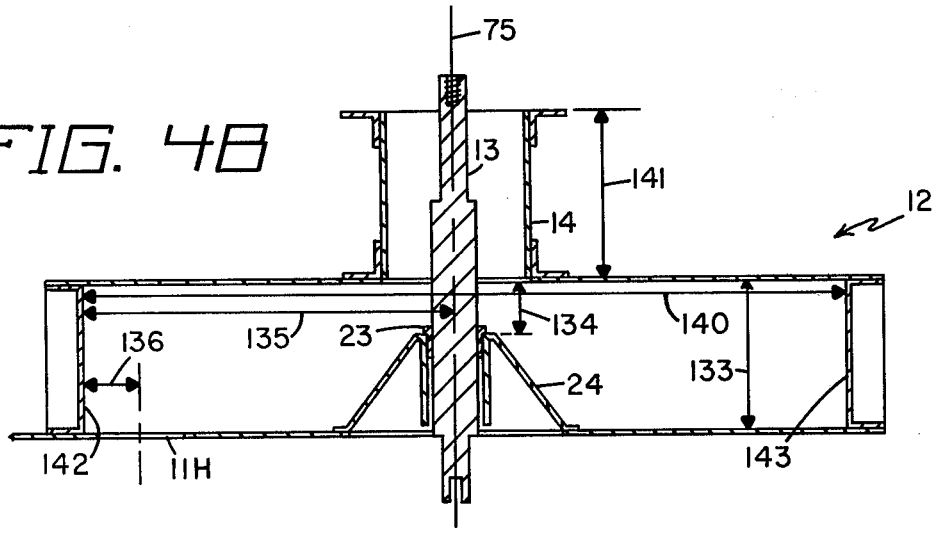
FIG. 4B is a side cross-sectional view of the waveguide coupling box of FIG. 4A which is enlarged compared to FIG. 1 for emphasizing its geometry and relative dimensions.

Referring to FIGS. 4A and 4B which show a plan view and a side cross-section of waveguide box 12 respectively, it is observed that box 12 has shorts 142 and 143, has a magnetron feed through hole 11H, has conductive microwave seal 24, and has centrally located coaxial feed portion 13,14, centered on axis of rotation 75. Box length 140 is 2.05 L. Box width 137 is 0.75 L. Box height 133 is 0.425 L. Coaxial tube 14 length 141 is 0.50 L when spacing 121 is 0.11 L. Magnetron hole 11H diameter 138 is 0.25 L and hole 11H is centered at a distance 136 of 0.15 L from short 142.

Coaxial tube 14 axis 75 is located at distance 135 of 1.0 L from short 142. The top of microwave seal 24 is recessed beneath the upper side of box 12 by distance 134 of 0.175 L. Dielectric sleeve 23 holds shaft 13 in the cylindrical portion of seal 24. Magnetron hole 11H and coaxial tube 14 are centered on the box width so that distance 139 is 0.375 L.

Oven cavity 2 of FIG. 1 is 4.65 L from side wall to side wall, 3.25 L high from bottom 5 to top 4, and 3.25 L deep from choke 7 to back wall 3. Coaxial tube 14 is mounted on wall 5 and centered on the width (side-to-side) and depth dimensions. The centering is not critical and tube 14 is also suitably located closer to door 6 when it is desired to permit more convenient insertion of smaller food objects into the oven in everyday use.

In a prototype oven in which uniformity heating tests were made, it was found that good results were obtained even in a combination microwave oven having an overhead broil, or browning, element mounted in cavity 2 and being suspended by vertical wire hooks 29A and 29B only. Although horizontal metal bracing elements (not shown) are sometimes utilized with a broil element in oven art, the use of such bracing was found to introduce nonuniformities of heating food objects and wire hooks were used in substitution for such bracing, in the particular tests.

Figure 5:
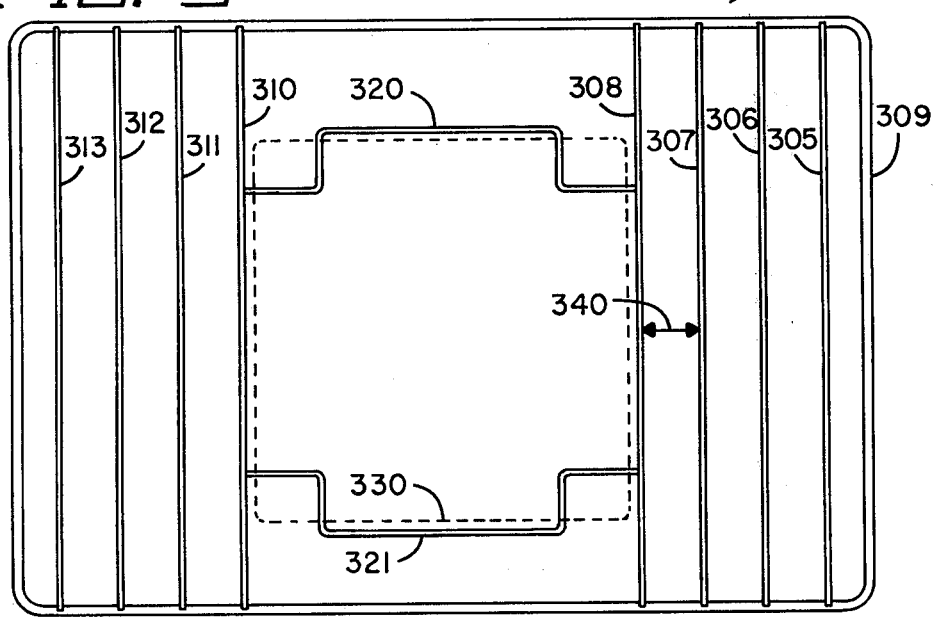
FIG. 5 is a plan view of a metal grill used in the oven of FIG. 1.

Referring to FIG. 5, a plan view shows grill 8 used in the tests. Grill 8 comprises support loop 309, grill rods 305,306,307,308,310,311,312, and 313, and tray rods 320 and 321. The transverse tray rods 320 and 321 hold a glass-ceramic window plate 330 for in turn supporting a food tray holding food body 9 of FIG. 1. The (340) spacing of the grill rods avoids frequency-sensitive dimensions such as a quarter wavelength, so that the grill does not detract from the uniform cooking pattern in the oven cavity 2.

Without limiting the true scope of the invention as defined in the claims, and to better motivate an understanding of the advantages provided by the present invention, an intuitive or heuristic tentative explanation of the operation of the preferred embodiment of the invention is here suggested.

It is of course to be understood that the stirring action involved in the inventive microwave ovens is an extremely complicated three-dimensional problem in electromagnetic field analysis. Given a set of cylindrical coordinates $(r,\theta,z)$ with its origin at point 109 on plate 20 one can identify each location in the oven cavity 2 by its coordinate position. Using an angular position variable $\theta$, each position of antenna plate 20 can be identified in its circle of rotation. Then given an energy-absorbing load 9 in cavity 2, the stirrer sets up a heating function $H(r,\theta,z,\phi)$ having dimensions of watts per unit volume at every point $(r,\theta,z)$ in the load 9 at any given position $\phi$ of stirrer antenna 20. This heating function is the rate of addition of heat by absorption of microwave energy from the feed system. If the food body is at a uniform temperature throughout its volume at the beginning of heating and each particle of the food body increases in temperature the same amount given the same amount of added heat, then a heating function which is properly stirred to be constant in $r,\theta$, and z should suffice to uniformly cook the food or heat the object. Unfortunately it cannot be said at the outset that given a stirrer antenna that the heating function is the same for different oven cavities, different grills and other elements in the cavity, and for different loads (e.g. pork roast, chocolate cake, turkey, hamburger in bun, container of liquid).

However, the mathematics does provide some clarification of the stirring problem and hopefully some illumination of the advantages of the inventive ovens.

By conservation of energy, the power transmitted (P) into cavity 2 from the generator and not reflected back is equal to the power absorbed in the cavity, and assuming load 9 is the only absorptive body in the oven, the absorbed power is $$P = \frac{1}{2\pi} \int_{\phi=0}^{2\pi} \int_{\substack{\text{load}\\ \text{volume}\\ V}} H(r,\theta,z,\phi)\, dV(r,\theta,z)\, d\phi \tag{1}$$

In words, the absorbed power is the average over all stirrer angles of the integrated heating over the entire volume of the load.

The objective of stirring is to obtain uniform heating of the load. In mathematical symbols this stirring problem is indicated by $$\int_{\phi=0}^{2\pi} H(r,\theta,z,\phi)d\phi = K_o \tag{2}$$

where $K_0$ is a constant being the same throughout the volume of the load 9.

Beyond this point, the problem is for purposes of exposition drastically simplified by reducing it to one spatial dimension r and assuming that the stirrer occupies only two positions spaced apart by 180°. This is plausible for the first reason that obtaining uniformity in the height, or z, dimension does not appear to be a big problem at the 2450 MHz. wavelength and the stirrer has its structure mostly in a plane in the $r,\theta$ directions. Second, the uniformity in the $\theta$ direction does not appear to be a big problem because the cavity, while not cylindrical, is quite large, and because the load is usually more or less centered in the cavity 2. In addition the stirrer 20 is more or less centered in the cavity and it turns through a full 360° beneath the load so that the load sees about the same stirred pattern regardless of the angular position the load has. In other words it appears reasonable to consider that the heating function H is swung around through angles $\theta$ as the stirrer rotates through angles $\theta$ in view of the foregoing considerations and the at-most bilateral symmetry of the stirrer antenna 20. These considerations reduce the stirring problem to the following equation:

$$H(r,\phi)+H(r,\phi-180°)=K_1 \tag{3}$$

where $K_1$ is to be a constant throughout the volume of load 9 and in particular being constant at all radial distances r from axis of rotation 75 extended.

Figure 8B:
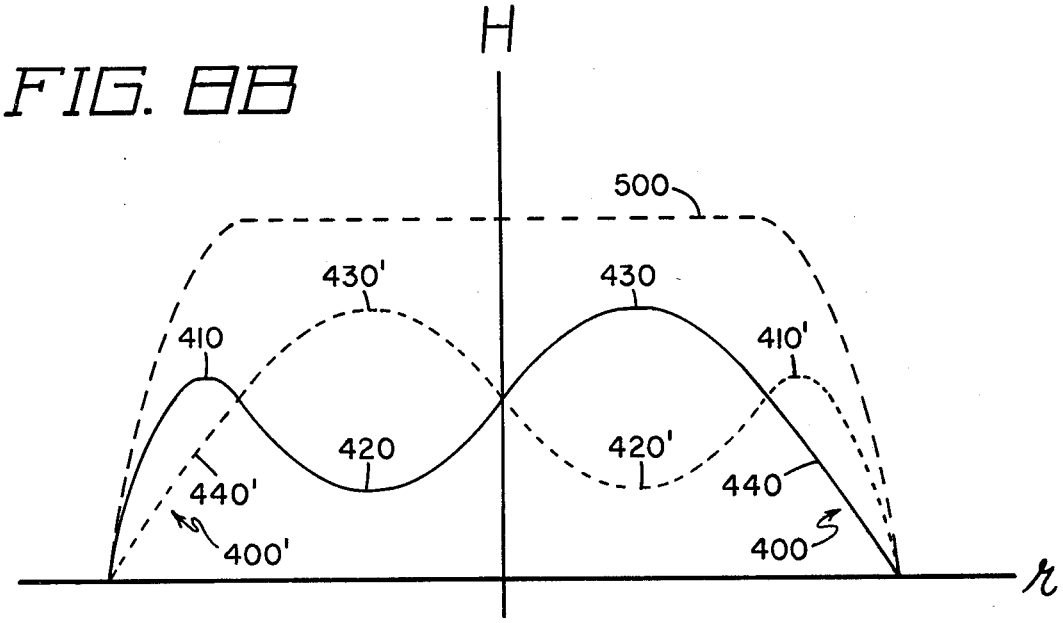
FIGS. 8A and 8B are respectively a simplified side view of a stirrer and a graphical analysis of the stirrer pattern for use in suggesting the uniform heating pattern obtained in ovens according to the invention.
Figure 8A:
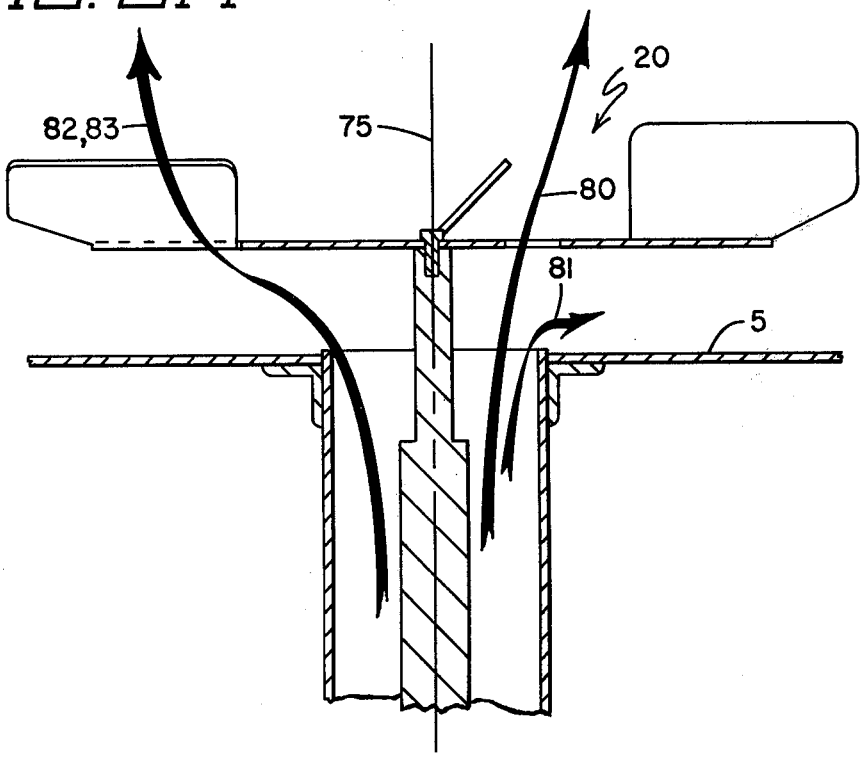

Referring now to FIGS. 8A and 8B, the next step is to relate the structure of the stirrer antenna 20 to the heating function H. FIG. 8A shows an extremely simplified side view of stirrer 20. Substantial radiation 80 passes directly to the cavity past the stirrer at a small radius on the right-hand side of axis 75. Not much radiation is left as component 81 to travel indirectly to the cavity at larger radii on the right-hand side of axis 75. On the left-hand side of axis 75 in FIG. 8A, by contrast, there is no slot or edge for admitting direct radiation so a substantial amount 82,83 of radiation passes beneath antenna 20 and is distributed at large radii on the left-hand side into the cavity. At small radii on the left-hand side of axis 75 there is no slot and the radiation there is quite small.

In a different way of describing the operation of antenna 20 the off-axis location of the inner edge, or slot, accomplishes a mode selection function which causes the vanes on opposite sides of axis 75 to support electric currents in the proper phase relationship so that the vanes radiate like a dipole. The slot radiation and the "dipole" radiation interact to produce the pattern of heating in the load.

It is plausible from the foregoing considerations, notwithstanding the extreme theoretical complexity of predicting the heating pattern in the distant load from the structure of the stirrer antenna, to suppose that the heating $H(r,\phi)$ is as shown by the very nonuniform curve 400 in FIG. 8B. Curve 400 has peak 410 corresponding large indirect radiation at large left-hand radii, valley 420 corresponding to very little indirect radiation at small left-hand radii, peak 430 corresponding to large direct radiation at small right-hand radii, and tail 440 corresponding to very little indirect radiation at large right-hand radii.

When heating pattern $H(r,\phi)$ is swung around 180°, or by half a rotation of stirrer 20, curve 400 is swung around and reversed to become curve 400' having corresponding peak 410', valley 420', peak 430', and tail 440' in reversed positions relative to curve 400. Curve 400' corresponds to the function $H(r,\phi-180°)$ in Equation (3).

Next the curves 400 and 400' are graphically added to obtain the stirred heating pattern obtained in the load when the antenna 20 is rotated. Remarkably, the result of this addition is the flat-topped curve 500 which represents substantially constant, uniform heating over all radial positions occupied by food bodies in the oven cavity. Thus, the stirrer antenna 20 produces a heating pattern which is a solution to the mathematical stirring problem represented by Equation (3). When the stirrer 20 is not rotated, it throws a relatively nonuniformly distributed heating pattern into the load. But when rotated the heating pattern is stirred together and comes out advantageously uniform.

The foregoing explanation is believed to account for the uniformity of cooking of foods when the grill 8 is used in the lowest position on ridge 16E. At higher grill positions, the radiation from aperture 30 and wings 35,36,37, and 38, directed upward perpendicular to wall 5, is increasingly combined into and approaches a pattern of a single diffuse beam which is more uniform in spatial distribution than curve 400. Thus, cooking uniformity is obtained at each rack position 16D, C, B, and A, above 16E.

In experimental testing, the stirring of the preferred embodiment of the inventive ovens is found to be remarkably uniform and yet the manufacturing cost is comparable to or less than that of prior art ovens due to the simplicity of the preferred embodiment.

The object of stirring being a uniform heating pattern, and Equation (3) having many possible solutions, it is not surprising that the present invention comprehends numerous embodiments. Some variations, for instance, in stirrer antennas for use in the invention are suggested.

Referring to FIG. 6, a stirrer antenna 150 has plate surface 155, vanes 151,152,153, and 154 and inner edge 161 forming a boxlike "C" shape. When rotated around point of attachment 160 the antenna 150 has exactly one axis of bilateral symmetry 163. The inner edge 161 forms an aperture which is more tangentially elongated than radially elongated, as is evident from visual inspection. Geometrically, this corresponds to the condition that the longest radial segment 162 which can be drawn in aperture 161 is shorter than the longest segment 164 which can be drawn perpendicular to any radius, here radius 166.

FIGS. 7A–7F show a few of many slot shapes having the same geometric property. Points of attachment 200,210,220,230,240, and 250 are drawn relative to slots 201,211,221,231,241, and 251. In each case the longest radial segment 202,212,222,232,242,252 which can be drawn in its respective aperture is shorter than the longest segment 204,214,224,234,244,254 which can be drawn perpendicular to any radius, here 206,216,226,236,246,256.

All such slots function as irises with a lower limit frequency for passage of microwave energy determined by the size and shape of the aperture. The size of the particular shape chosen frequently allows a substantial part of the feed radiation to pass through the slot. For a slot of uniform width, such as slot 201 of FIG. 7A, this suggests a slot length of near a half wavelength (0.5 L) or greater. For more general slot geometries such as those of FIGS. 7B–7F, the length of the longest segment which can be drawn perpendicular to any radius is on the order of a half wavelength. In the slot 30 of FIG. 2A, the length of the curved outside radius edge portion 62B exceeded 0.5 L in a model.

In some embodiments of the invention it is contemplated that the feed aperture such as 14A is partly exposed to cavity 2 by a given slot for microwave purposes even though a stirrer antenna is such as to cover the aperture from a visibility point of view. For example, in some embodiments, having the approximate geometry of arcuate slot 30 in antenna 20 of FIG. 2A but different dimensions, the inner radius of the aperture 30 exceeds the radius of surface 31 of coaxial tube 14. The parallel planes 64 and 5 of the antenna plate and the oven wall respectively constitute a radial transmission line with its center at the center 109. Such radial transmission line serves and functions as if tube 14 were extended radially outward and couples energy 80 to and through the slot even though the annular cross-section 63 of the feeder end is not visible through the slot along a line of sight parallel to the axis of rotation 75.

Still other stirrers comprehended in the invention, but not drawn, suitably take advantage of the principle that direct radiation 80 is substantially programmed by edge 62A (see FIG. 2A) and the surface 31 of aperture 14A and such stirrers permit edge 62A to be part of the periphery of the plate extending to only a vary small radius compared with the periphery of the plate on the opposite side of the plate from such feed-exposing edge 62A. Then no slot as such is used to accomplish the same stirring function and radiative programming as the plate rotates.

In additional embodiments, the center shaft 13 is supported by a free turning bearing. The stirrer antenna 20 is then caused to rotate by a current of air from blower apparatus, directed against the wings of the antenna. For air flow in the plane of rotation 64, the wings are suitably adjusted in angle to obtain a uniform rate of rotation.

A person skilled in the art will, in general, in practicing the present invention for the first time construct an initial design of a microwave oven according to the invention. Then in order to use the invention to best advantage a testing and adjustment procedure such as the one next described is used.

Step 1. Cold Test. With magnetron 11 removed an oven cavity provided with typical load 9, use a standard microwave probe located in place of magnetron 11 at hole 11H to measure impedance presented. Object is to adjust feed system to obtain an impedance seen by the probe which matches the desired magnetron load impedance. Stirrer is manually rotated to check for approximately uniform impedance at all positions.

Step 2. Cold adjustment. If cold test shows adjustment required, then adjust coaxial shaft matching section in diameter/length of turned-down section 13B just beneath antenna 20. Adjust shorts 143 and 142 of waveguide box 12 for coarse tuning if necessary and recheck Step 1.

Step 3. Power test. Replace magnetron 11 on box 12. Place beaker with water load in oven cavity. Do power test by energizing magnetron 11 for preset length of time and measuring temperature rise in beaker. Using standard calorimetric principles, calculate power in watts delivered to water load (one liter, for example) and compare with power output expected from magnetron 11 in matched condition. If power into load departs substantially from matched condition, readjust matching, and redo cold test until matching is obtained with power test.

Step 4. Center-loading Test. Provide load, such as many frankfurters spread along grill 8 over area above stirrer 20. With power on, cook the frankfurters. If portions of frankfurters directly above stirrer 20 do not cook as fast as those farther out from axis of rotation 75, then enlarge curved slot 30 in plate 20, or reduce spacing between plate 20 and feed aperture 14A, or both, to increase direct radiation 80 and center power H. Slot size appears to affect center power more than the heating at larger radii on the grill contents being heated. Cycle back to step 1 and rematch, if necessary, until center loading and matching are obtained at this Step 4.

Step 5. Edge-loading Test. Place absorptive body with substantial radial extent, such as a pan of cake batter, onto grill 8. Turn power on and bake cake. If edge portions have not cooked as fast as the center, adjust vane angles and vane sizes by bending the vanes first and trimming their size if necessary. The vanes appear to affect edge heating (heating of load at large radii) more than center heating. After adjusting vanes, cycle back to Step 3 Power Test. If power has dropped less than 5% or so, then continue with Step 4 center test and Step 5 edge tests, otherwise rematch. Check cake for nonuniformities anywhere in cake. Compare nonuniformities by location with corresponding stirrer structure in case part of stirrer 20 structure can be identified visually for adjustment. For example, if the cake exhibits an overheated or underheated annular, or ring-shaped, portion, adjust corresponding part of stirrer 20 nearest annulus.

Step 6. Final Testing. Test oven with a variety of food bodies of different compositions, sizes, and shapes and adjust stirrer 20, if necessary.

From the standpoint of uniformity of heating and cooking, the microwave ovens of the invention operate as a synergistic whole, and all parts which channel, reflect, and absorb microwaves potentially affect its practical utility. The present invention comprehends numerous embodiments which may be constructed by the skilled worker so that the utility of the invention can be fully realized.

What is claimed is:

1. A microwave oven comprising a main oven body having walls and a reclosable door defining a heating cavity and further comprising a high frequency feeder section having a feeder opening for supplying microwave energy into said heating cavity WHEREIN THE IMPROVEMENT COMPRISES a planar antenna plate having one and only one inner edge defining a single aperture for admission of said microwaves from only a part of said feeder opening directly across the plane of said plate to said cavity, said antenna plate comprising electrically conductive material having a periphery and having a plurality of conductive wings on said periphery, said aperture having a bisector being a one and the only one axis of bilateral symmetry of said antenna plate, said plate being located to have a spacing from said feeder opening so as to permit propagation of said microwave energy from the rest of said feeder opening to said wings and to said cavity;

shaft means for extending through said feeder opening and being attached at a point of attachment to and holding said plate for said spacing of said plate from said feeder opening, said aperture being shaped so that the longest straight line which can be drawn inside said aperture along a radius through said point is shorter than the longest straight line which can be drawn inside said aperture perpendicular to any radius through said point; and means for rotating said plate so that said inner edge rotates relative to said feeder opening, whereby uniform microwave heating of a body to be heated in said cavity is achievable.

2. A microwave oven as claimed in claim 1 wherein said aperture is an arcuate aperture being so located that it forms part of an imaginary circle having a center located at said point of attachment.

3. A microwave oven as claimed in claim 1 wherein said antenna plate plurality of wings is a plurality of wings bent from said periphery along bending lines, said bending lines lying along imaginary lines passing through said point of attachment.

4. A microwave oven as claimed in claim 3 wherein said antenna plate plurality of wings is four wings, said bending lines are successively spaced at 90° angles around said plate, two of said wings are bent at an acute angle relative to the plane of said antenna plate and the other two of said wings are bent at substantially right angles relative to the plane of said antenna plate, said aperture is an arcuate aperture subtending an angle of between 150° and 210° and being so located that it forms part of an imaginary ring having a center located at said place of attachment.

5. A microwave oven comprising a case defining a substantially closed metallic cavity adapted to hold an energy absorbing load, and feed means for generating and coupling microwave energy into said cavity, said feed means ending at a feed aperture to said cavity, WHEREIN THE IMPROVEMENT COMPRISES a field stirrer rotatably mounted over and covering said feed aperture, said field stirrer being a single conductive plate having a plane of said plate and having one and only one inner edge defining a single curved opening in said plate and exposing only a portion of said feed aperture to said cavity through said curved opening at any position of said plate during rotation of said plate, said plate having a plurality of vanes on said plate outside said aperture with said vanes and said curved opening being so located that electrically identical positions of said plate occur only every full circle of rotation, said plate including peripheral conductive material, said vanes extending from said peripheral conductive material, all of said peripheral conductive material of said plate being in the plane of said plate and being all of the peripheral conductive material of said field stirrer, said plate being spaced from said feed aperture into said cavity by a distance between 0.025 (1/40) and 0.25 (¼) of a free-space wavelength of said microwave energy, whereby uniform microwave heating of said energy absorbing load in said cavity is able to be accomplished.

6. The microwave oven claimed in claim 5 wherein said plate is bilaterally symmetric and said plate has only one axis of bilateral symmetry.

7. The microwave oven claimed in claim 5 wherein said curved opening is an arc-shaped slot having an inside radius and an outside radius and said outside radius is between 1½ and 2½ times said inside radius, and said outside radius is within plus or minus 40% of being a quarter of said free-space wavelength.

8. A microwave oven comprising a case defining a substantially closed metallic cavity adapted to hold an energy absorbing load, and feed means for generating and coupling microwave energy into said cavity, said feed means ending at a feed aperture to said cavity,

WHEREIN THE IMPROVEMENT COMPRISES a field stirrer rotatably mounted over and covering said feed aperture, said field stirrer being a single conductive plate having one and only one inner edge defining a single curved opening in said plate and exposing only a portion of said feed aperture to said cavity through said curved opening at any position of said plate during rotation of said plate, said plate having a plurality of vanes outside said aperture with said vanes and said curved opening being so located that electrically identical positions of said plate occur only every full circle of rotation, said plate being spaced from said feed aperture into said cavity by a distance between 0.025 (1/40) and 0.25 (¼) of a free-space wavelength of said microwave energy.

said curved opening being an arc-shaped slot having an inside radius and an outside radius and said outside radius being between 1½ and 2½ times said inside radius, and said outside radius being within plus or minus 40% of being a quarter of said free-space wavelength, said field stirrer having an axis of rotation, said arc-shaped slot being centered on said axis, said vanes being exactly four in number and each of said vanes having a radial dimension of within plus 50% or minus 20% of being 0.40 of said free-space wavelength and a transverse dimension being within plus 20% or minus 50% of being half of said radial dimension, and at least part of each said vane being located 0.60 of said free-space wavelength away from said axis, whereby uniform microwave heating of said energy absorbing load in said cavity is able to be accomplished.

9. The microwave oven claimed in claim 8 wherein said plate has a periphery having at least one arcuate outer edge portion centered on said axis, said outer edge having a radius within plus or minus 20% of being 0.60 of said free-space wavelength.

10. The microwave oven claimed in claim 8 wherein said plate has a periphery and said vanes are bent from said periphery along lines of bending being along radii on said plate from said axis, and said periphery has at least two parallel opposite edge portions being at a distance apart of within plus or minus 20% of being 0.80 of said free-space wavelength.

11. The microwave oven claimed in claim 8 wherein said plate has a periphery and each of said vanes extends beyond said periphery; said oven cavity has substantially the shape of a rectangular parallelepiped defining inside walls of said cavity; and said feed aperture is centered on an inside wall of said cavity relative to at least one dimension of said inside wall.

12. A microwave oven having a cavity for microwave heating therein, a generator of microwaves, and waveguiding means for carrying said microwaves from said generator to said cavity CHARACTERIZED IN THAT said waveguiding means has an inside surface of approximately circular cross-section near said cavity, said inside surface having an axis, said waveguiding means further comprising a rotatable shaft disposed coaxially within said inside surface so as to define a cross-section being substantially annular between said shaft and said inside surface of said waveguiding means for passage of said microwaves therethrough; and said microwave oven further comprises an antenna being one and only one flat plate having a plane of said plate and being attached to said shaft substantially perpendicular to said axis, said antenna plate having one and only one inner edge defining a single arcuate aperture for admission of said microwaves from only part of said annular cross-section directly across the plane of said plate to said cavity, said antenna plate being electrically conductive material having a periphery and part of said material being bent from periphery as a plurality of wings in such locations on said plate that said antenna exhibits bilateral symmetry at most, said waveguiding means inside surface having an end, said shaft projecting beyond said end to said antenna plate so as to permit propagation of said microwaves from the rest of said annular crosssection to said wings and to said cavity.

13. The microwave oven claimed in claim 12 wherein said antenna plate plurality of wings is exactly four wings bent along bending lines, said shaft and said antenna plate being attached substantially at a point where said axis intersects said plate, said bending lines lying along radii along said plate from said point.

14. The microwave oven claimed in claim 13 wherein said arcuate aperture extends through an arc having a chord, and said chord lies at an angle of substantially 45° relative to each of said bending lines.

15. The microwave oven claimed in claim 12 wherein said arcuate aperture has an outer radius and said periphery has a maximum radial extent dimension, said shaft and said antenna plate being attached substantially at a point where said axis intersects said plate, said arcuate aperture being so located that it forms part of an imaginary circle having a center located at said point, said outer radius being measured from said center, said maximum radial extent dimension being the greatest distance from said center to any part of said periphery lying in the plane of said plate, said outer radius being within plus or minus 20% of being 0.40 of said maximum radial extent dimension.

16. A microwave oven having a cavity for microwave heating therein, a generator of microwaves, and waveguiding means for carrying said microwaves from said generator to said cavity CHARACTERIZED IN THAT said waveguiding means has an inside surface of approximately circular cross-section near said cavity, said inside surface having an axis, said waveguiding means further comprising rotatable shaft disposed coaxially within said inside surface so as to define a cross-section being substantially annular between said shaft and said inside surface of said waveguiding means for passage of said microwaves therethrough; and said microwave oven further comprises an antenna being one and only one flat plate having a plane of said plate and being attached to said shaft substantially perpendicular to said axis, said antenna plate having a curved edge exposing only a portion of said annular cross-section for admission of said microwaves directly across the plane of said plate to said cavity, the balance of said annular cross-section opposite said curved edge being covered by said plate by a portion of said plate opposite said curved edge, said antenna plate being electrically conductive material, said portion of said plate opposite said curved edge having a periphery and wings for indirectly radiating said microwaves from the balance of said annular cross-section opposite said curved edge, said plate being so shaped and rotatable that physically identical positions of said plate occur only every full circle of rotation, all of said periphery being in the plane of said plate, said waveguiding means inside surface having an end, said shaft projecting beyond said end to said antenna plate, said plate being spaced from said end into said cavity by a distance between 0.025 and 0.25 free-space wavelength of said microwave energy.

* * * * *